343-700 MS AU 251 EX
2/17/87 OR 4,644,360

United States Patent [19]

Mead et al.

[11] Patent Number: 4,644,360

[45] Date of Patent: Feb. 17, 1987

[54] MICROSTRIP SPACE DUPLEXED ANTENNA

[75] Inventors: James B. Mead, Brookside; Leonard Schwartz, Montville, both of N.J.; Emile J. DeVeau, Pleasantville, N.Y.

[73] Assignee: The Singer Company, Little Falls, N.J.

[21] Appl. No.: 695,773

[22] Filed: Jan. 28, 1985

[51] Int. Cl.[4] ..... H01Q 3/24; H01Q 1/38

[52] U.S. Cl. ..... 343/700 MS; 343/771

[58] Field of Search ..... 343/700 MS, 770, 771, 343/876

[56] References Cited

U.S. PATENT DOCUMENTS

| | | | |
|---|---|---|---|
| 3,508,275 | 4/1970 | Deveau et al. | 343/771 |
| 4,340,892 | 7/1982 | Brunner et al. | 343/771 |
| 4,347,516 | 8/1982 | Shrekenhamer | 343/700 MS |

*Primary Examiner*—Eli Lieberman
*Attorney, Agent, or Firm*—T. W. Kennedy

[57] ABSTRACT

Separate receive and transmit interleaved arrays are distributed throughout a defined area. Each array is interconnected, at opposite ends thereof, to a feed line so that the receive and transmit antennas are each associated with four beams. Feed through connections are employed between receive feed lines and the receive arrays of the antenna thereby permitting the utilization of a microstrip structure.

4 Claims, 4 Drawing Figures

MICROSTRIP SPACE DUPLEXED ANTENNA

FIELD OF THE INVENTION

The present invention relates to microstrip antennas and more particularly to a microstrip antenna structure having space-duplexed transmit and receive antennas. For some time, it has been recognized that space-duplexed antennas allow the use of lower-cost R.F. components by providing increased isolation of the receiver from transmitter noise. In addition, higher power transmitters may be used with low noise amplifiers enabling operation of aircraft at higher altitudes and over very smooth water. Conventional space-duplexed antennas are mounted side by side, requiring approximately twice the space, weight and cost of a single atenna. If an effort is made to reduce the size of the side-by-side antennas by a factor of two, the gain and beamwidth in one direction is likewise reduced by a factor of two.

The present assignee has developed a previous structure utilizing two separate microstrip antennas which are interleaved, on a single plane, to occupy substantially the same space as a single antenna. Each of the interleaved antennas includes its own feed and each antenna aperture produces two beams for a total of four beams. This antenna is applicable to non-space duplexed antenna doppler systems. Each beam simultaneously transmits and receives energy. The present invention extends the interleaved concept to space duplexed systems.

BRIEF DESCRIPTION OF THE PRESENT INVENTION

The present invention is composed of a single panel of interleaved independent four-beam space-duplexed microstrip antennas. The transmit ports fed directly into one of the antennas, while the receive ports are transferred, via feed through pads, to the other. By virtue of utilizing separate receive and transmit antennas, each operating with four beams, maximum gain for a particular space may be realized. By properly spacing the arrays of the antennas, a satisfactory level of isolation may be obtained. Further, the present design is capable of exhibiting a significant signal-to-noise ratio so that it may be incorporated in aircraft operating at high altitudes with significant power levels.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
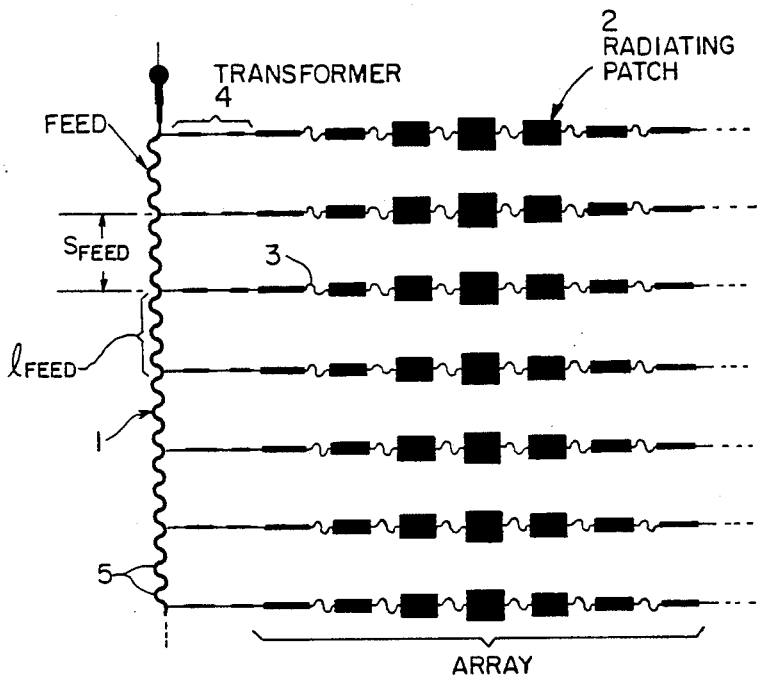
FIG. 1 PRIOR ART
FIG. 1 illustrates a section of a prior art antenna structure.

In a typical microstrip antenna of the type described in the mentioned prior art and shown in FIG. 1, a single feed, indicated at reference numeral 1, is attached to a plurality of arrays of patch radiators such as shown at 2.

The patches are half-wave resonators, which radiate power from the patch edges. In order to control beam width, beam shape and side lobe level, the amount of power radiated by each patch must be set. The power radiated is proportional to the patch conductance, which is related to wavelength, line impedance and patch width. These patches are connected by phase links such as indicated at 3, which determine the beam angle relative to the axis of the arrays.

The arrays formed by patches and phase links are connected to the feed line through a two-stage transformer 4 which adjusts the amount of power tapped off the feed 1 into the array. The feed is made up of a series of phase links 5 of equal length, which control the beam angle in the plane perpendicular to the arrays. The feed is also a traveling wave structure. The power available at any given point is equal to the total input power minus the power tapped off by all previous arrays. These structures are broadband being limited only by the transmission medium and the radiator bandwidth. In this case, the high Q of the patch radiators limits the bandwidth to a few percent of the operating frequency.

Figure 2A:
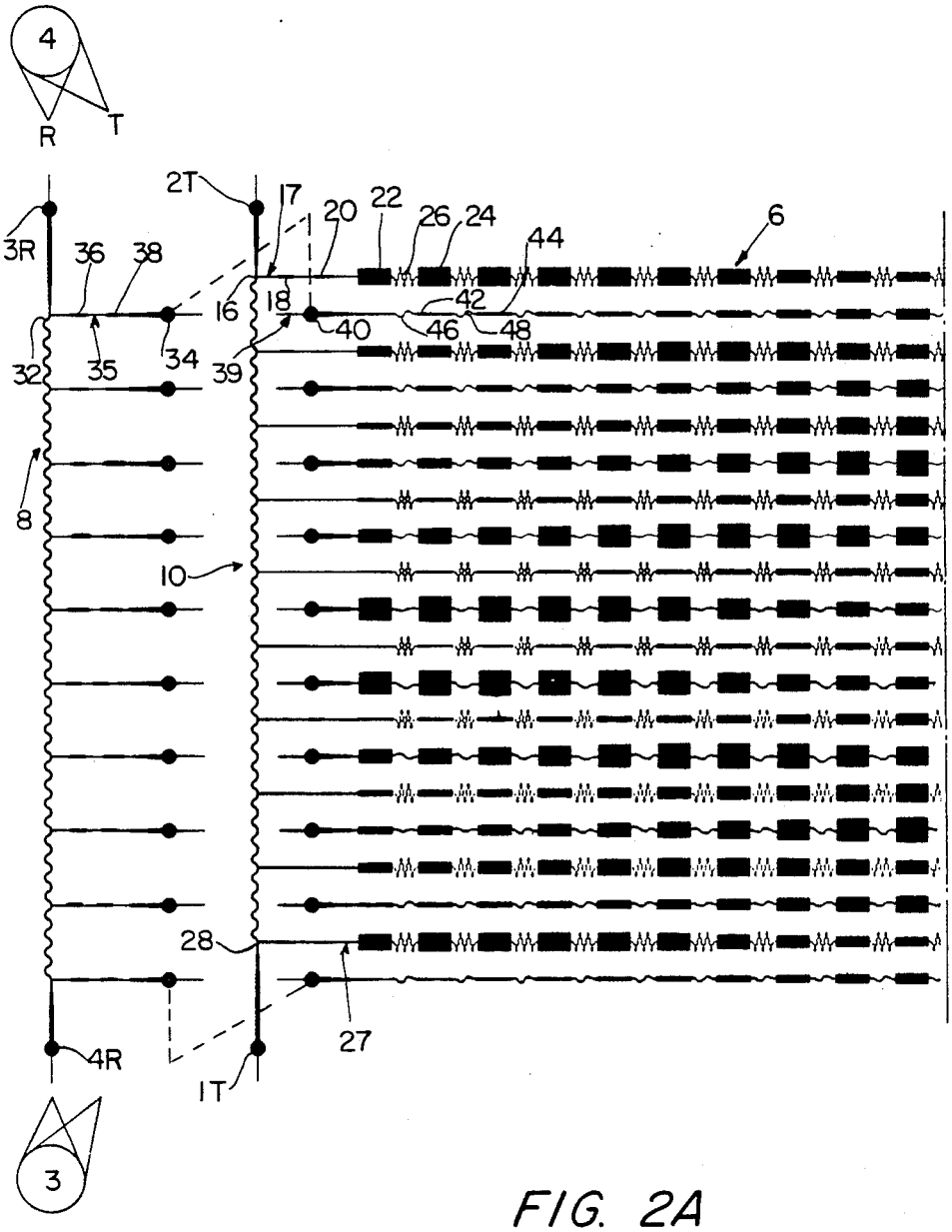
FIG. 2A is a illustration of a first half of the antenna structure of the present invention.
Figure 2B:
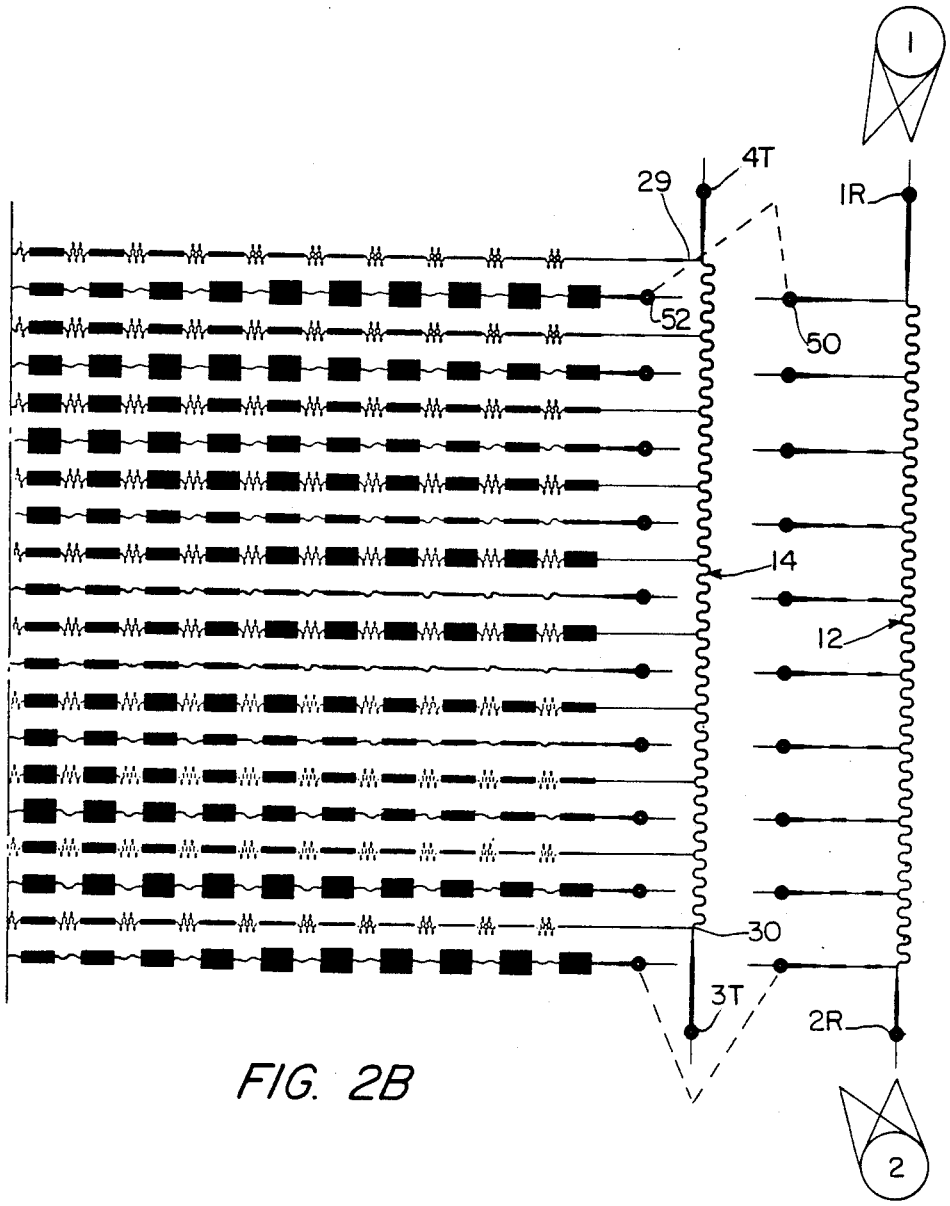
FIG. 2B is an illustration of a second half of the antenna structure of the present invention.

Referring to FIGS. 2A and 2B, reference numeral 6 generally indicates the printed circuit artwork for etching interleaved space-duplexed antennas of the present invention. As will be observed, the odd-positioned arrays are connected to feed lines 10 and 14, at opposite ends thereof thereby defining the transmitting antenna of the invention. Feed lines 8 and 12 are connected, by feed through terminals, to be discussed hereinafter, to the evenly positioned arrays thereby constituting a separate receive antenna, both the receive and transmit antennas being space duplexed within the area defined by the printed circuit.

Considering FIG. 2A in greater detail, junction point 16 connects transmit feed 10 to the first odd (uppermost) array 17 having first and second stage transformers 18 and 20 connecting the feed line 10 with serially connected radiating patches including 22 and 24 conductively separated by phase links 26. The opposite end of the first odd-positioned array 17 defines junction point 29 connected to transmitter feed line 14. The lowermost transmitter array generally indicated by reference numeral 27, shown in FIG. 2A, has its leftmost end connected to transmitter feed line 10 at junction point 28. The opposite end of this array is connected to the second transmitter feed line 14 to junction point 30 as shown in FIG. 2B. By feeding transmitter energy to the transmitter feed line ports 1T, 2T, 3T and 4T, four beams, as indicated in the corners of FIGS. 2A and 2B, become generated.

Receive feed lines 8 and 12 are oriented in parallel-spaced relation to their counterpart transmit feed lines 10 and 14 but are cut from the circuit board and are physically located on an opposite face of a printed circuit from that of the arrays. Connections between the receive feed lines and the receive arrays are accomplished by the utilization of feed through connections, as will be discussed in greater detail in connection with FIG. 3. Conduction of received energy passing along receive feed line 8 occurs at regularly spaced tapoff points such as the junction point 32 serially connected to two-state transformers 36 and 38 along a first feed strip 35, which terminates in a feed through pad 34. As indicated by dotted line, the feed through pad 34 is interconnected with feed through pad 40 which defines the left end of the uppermost even-positioned array 39.

Thus, traveling received energy along feed line 8 will be communicated directly with the even arrays constituting the receiver antenna, these arrays being interleaved with the odd-positioned arrays of the transmitting antenna. As in the case of the transmitting antenna array 17, phase links such as 46 and 48 interconnect the serially connected receive array patches including 42 and 44. The right end of array 39 is interconnected with the second receive feed line 12 by means of respective feed through pads 52 and 50, as indicated by the dotted line.

Similar interconnections between the four feed lines and their respective arrays are repeated so that both the receive antenna and transmit antenna are respectively associated with four beams.

Figure 3:
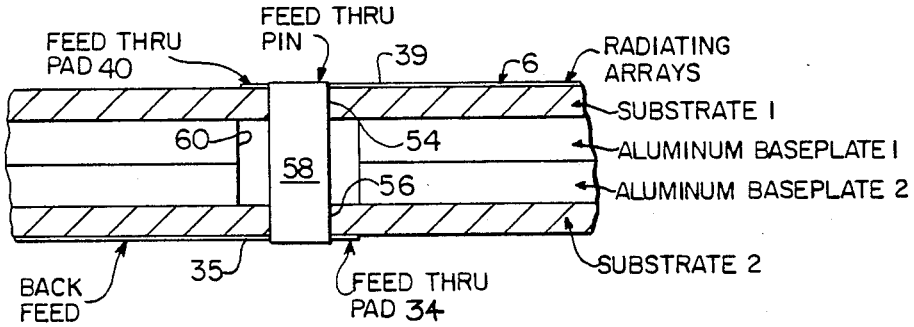
FIG. 3 is a detailed illustration of the feed through connection as utilized in the present invention.

FIG. 3 is a detailed view of the feed through construction. By way of example, the feed through connection between pads 40 and 34 is illustrated. The plane of the interleaved arrays 6 is illustrated as facing upwards while the conductive feed through strip 35 faces downward and their respective feed through pads 40 and 34 are positioned in spaced alignment. Opening 54 and 56 are respectively formed in substrate "1" of the antenna arrays and substrate "2" of the feed through strip. An enlarged opening 60 is formed through aluminum baseplates "1" and "2" respectively attached to the antenna structure and feed through strip. The feed throughs are completed by soldering pin 58 located between the two etched feed through pads 40 and 34.

Since isolation between transmit and receive antennas is of primary concern, care must be taken to reduce the mutual coupling between adjacent arrays. Obviously, the greater the spacing between the arrays, (feed spacing), the higher the isolation. However, in order to keep higher order lobes from forming, the feed spacing should not greatly exceed the substrate wavelength (typically 0.59 inch). A typical spacing of 0.61 inch may be selected to optimize isolation and suppress unwanted beams. Predicted patterns at this spacing may produce higher order lobes below 25 dB.

Mutual coupling is also a function of adjacent patch alignment. It has been found experimentally that the greatest isolation was achieved when the patches of the transmit antenna line up opposite the receive antenna patches. Therefore, the array spacing for both antennas may be selected at a typical value of 0.485 inch.

In order to achieve proper beam shaping for overwater error correction, the invention employs gamma-psi separable amplitude functions. Since the antenna must be fed from four corners, these amplitude functions are folded to give symmetrical beam shaping. The amplitude functions are designed to radiate most of the input power in the first half of the antenna, minimizing the effect of the fold.

According to the above-described invention, it will be appreciated that an interleaved microstrip space-duplexed antenna is offered which includes separate receive and transmit antennas, each being associated with four beams to optimize power handling capability within a fixed area with an attendant high S/N ratio. By having each of the receive and transmit antennas existing throughout the defined area of the antenna structure, full gain may be realized.

It should be understood that the invention is not limited to the exact details of construction shown and described herein for obvious modifications will occur to persons skilled in the art.

We claim:

1. A four-beam space-duplexed antenna comprising:

a first plurality of interconnected radiating patches arranged as microstrip arrays forming a transmitting antenna, the arrays being distributed within a preselected area;

a second plurality of interconnected radiating patches arranged as microstrip arrays forming a receiving antenna, the receiving arrays being distributed within the preselected area and in interleaved coplaner relation to the transmitting arrays;

a first feed line having a plurality of tapoff points defined therealong for connection to corresponding first ends of a coplanar first array set corresponding to the transmitting or receiving arrays;

a second feed line having a plurality of tapoff points defined therealong for connection to corresponding second ends of the coplanar first array set;

a third feed line having a plurality of tapoff points defined therealong for connection to corresponding first ends of a remaining set of the transmitting or receiving arrays which are positioned in spaced planar relation to the third feed line;

a fourth feed line having a plurality of tapoff points defined therealong for connection to corresponding second ends of the second array set which is positioned in spaced planar relation to the fourth feed line;

wherein the transmitting and receiving antennas each operate with four beams of electromagnetic energy; and wherein each end of the arrays constituting the second set have feed through pads connected thereto, and further wherein the tapoff points of the third and fourth feed lines have feed through pads connected thereto for facilitating feed through connections therebetween, and further wherein each feed through pad of the third and fourth feed lines has a connection means for connecting said feed through pad to its corresponding feed through pad of the arrays constituting the second set.

2. An antenna as set forth in claim 1 wherein said connection means is a feed through pin connected between the pads of the arrays and the feed lines, respectively, for completing connections therebetween.

3. The antenna set forth in claim 2 wherein the radiating patches of an array are interconnected by phase links.

4. The antenna set forth in claim 3 wherein each of the feed lines comprises a conductive section of repeating serpentine segments.

* * * * *